US008668490B2

(12) United States Patent
Happe et al.

(10) Patent No.: US 8,668,490 B2
(45) Date of Patent: Mar. 11, 2014

(54) METHOD AND ARRANGEMENT FOR IGNITING A GAS FLOW

(75) Inventors: Barbara Happe, Gernrode (DE); Jürgen Blank, Gernrode (DE)

(73) Assignee: Mertik Maxitrol GmbH & Co. KG, Thale (DE)

( * ) Notice: Subject to any disclaimer, the term of this patent is extended or adjusted under 35 U.S.C. 154(b) by 1783 days.

(21) Appl. No.: 10/545,048

(22) PCT Filed: Feb. 11, 2004

(86) PCT No.: PCT/EP2004/001243

§ 371 (c)(1),
(2), (4) Date: Aug. 11, 2005

(87) PCT Pub. No.: WO2004/072554

PCT Pub. Date: Aug. 26, 2004

(65) Prior Publication Data

US 2006/0068349 A1 Mar. 30, 2006

(30) Foreign Application Priority Data

Feb. 13, 2003 (DE) ..... 103 05 929

(51) Int. Cl.
*F23N 5/10* (2006.01)

(52) U.S. Cl.
USPC ..... 431/80; 431/18; 431/42; 431/43; 431/51; 431/60

(58) Field of Classification Search
USPC ..... 431/18, 42, 43, 45, 46, 47, 51, 60, 62, 431/63, 72–74
See application file for complete search history.

(56) References Cited

U.S. PATENT DOCUMENTS

| | | | | | |
|---|---|---|---|---|---|
| 2,224,187 | A | * | 12/1940 | Jackson | 137/553 |
| 3,034,571 | A | * | 5/1962 | Matthews | 110/187 |
| 3,247,868 | A | * | 4/1966 | Ray | 137/628 |
| 3,597,138 | A | * | 8/1971 | Ray | 431/54 |
| 3,999,932 | A | * | 12/1976 | Matthews | 431/16 |

(Continued)

FOREIGN PATENT DOCUMENTS

| | | | | |
|---|---|---|---|---|
| DE | 9307895 | U1 | 7/1993 | |
| EP | 837283 | A1 * | 4/1998 | F23N 1/00 |

(Continued)

OTHER PUBLICATIONS

Translation of International Preliminary Search Report on Patentability for International Application No. PCT/EP2004/001243.

*Primary Examiner* — Avinash Savani
(74) *Attorney, Agent, or Firm* — Howard & Howard Attorneys PLLC

(57) ABSTRACT

The invention relates to a method and an arrangement for igniting a gas flow by means of remote control. The aim of the invention is to maintain the current consumption so low that an integratable voltage source can be used. To this end, a thermoelectric safety pilot valve (17) is opened and the escaping gas ignited by the actuation of an electronic control unit (5) fed by a voltage source. Said thermoelectric safety pilot valve (17) is maintained open by a safety pilot magnet (18) by means of a holding current from the voltage source until a thermocouple (22) provides the required holding current once the gas flow has been ignited or a defined holding time is exceeded.

6 Claims, 4 Drawing Sheets

(56) References Cited

U.S. PATENT DOCUMENTS

Figure 1:
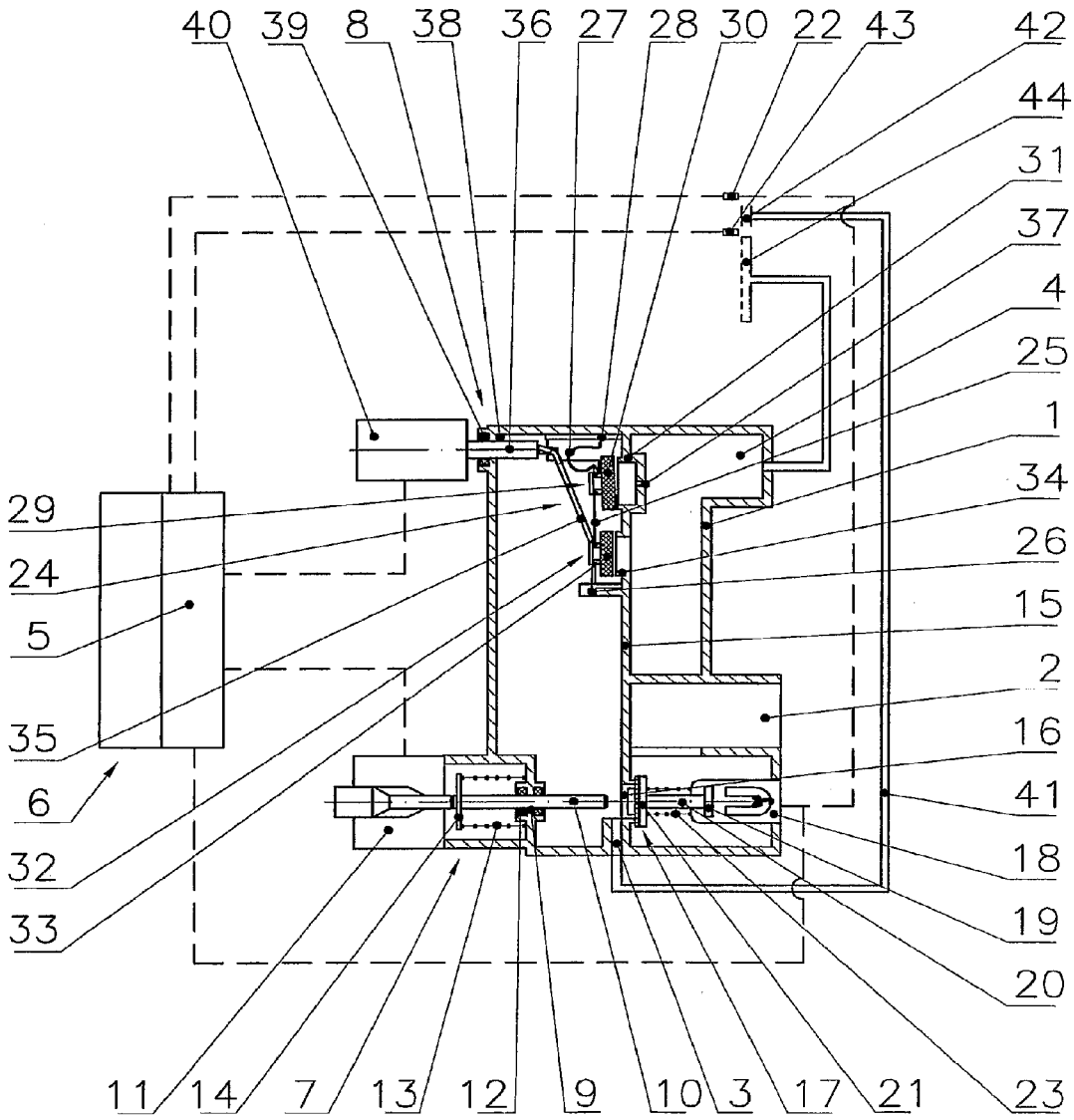

| | | | | | |
|---|---|---|---|---|---|
| 4,111,639 | A * | 9/1978 | Matthews | 431/25 |
| 4,318,687 | A * | 3/1982 | Inoue | 431/54 |
| 4,360,338 | A * | 11/1982 | Katchka | 431/46 |
| 4,483,672 | A * | 11/1984 | Wallace et al. | 431/20 |
| 4,511,326 | A * | 4/1985 | Lacroix | 431/53 |
| 4,770,629 | A * | 9/1988 | Bohan, Jr. | 431/59 |
| 4,778,378 | A * | 10/1988 | Dolnick et al. | 431/79 |
| 4,806,095 | A * | 2/1989 | Goldstein et al. | 431/54 |
| 4,874,362 | A * | 10/1989 | Wiest et al. | 604/26 |
| 5,181,846 | A * | 1/1993 | Chang | 431/80 |
| 5,193,993 | A * | 3/1993 | Dietiker | 431/51 |
| 5,622,200 | A * | 4/1997 | Schulze | 137/66 |
| 5,636,978 | A * | 6/1997 | Sasaki | 431/69 |
| 5,720,608 | A * | 2/1998 | Aoki et al. | 431/80 |
| 5,722,823 | A | 3/1998 | Hodgkiss | |
| 5,931,655 | A * | 8/1999 | Maher, Jr. | 431/14 |
| 6,261,087 | B1 * | 7/2001 | Bird et al. | 431/80 |
| 6,308,895 | B1 * | 10/2001 | Atxa et al. | 237/2 A |
| 6,346,789 | B1 * | 2/2002 | Bird et al. | 318/480 |
| 6,354,830 | B1 * | 3/2002 | de Nanclares | 431/80 |
| 6,561,138 | B2 * | 5/2003 | Kobayashi et al. | 122/14.2 |
| 6,666,676 | B2 * | 12/2003 | Rodriguez-Rodriguez et al. | 431/67 |
| 2006/0068348 | A1 * | 3/2006 | Blank et al. | 431/78 |
| 2007/0224558 | A1 * | 9/2007 | Flick et al. | 431/75 |

FOREIGN PATENT DOCUMENTS

| | | | | |
|---|---|---|---|---|
| EP | 1070919 | A2 | 1/2001 | |
| EP | 1106923 | A2 * | 6/2001 | F23N 1/00 |
| GB | 2267335 | * | 12/1993 | F23N 1/00 |
| GB | 2351341 | A * | 12/2000 | F23N 5/20 |
| JP | 03113206 | A * | 5/1991 | F23N 5/00 |

* cited by examiner

METHOD AND ARRANGEMENT FOR IGNITING A GAS FLOW

CROSS REFERENCE TO RELATED APPLICATION

This application claims priority to and all the advantages of International Application No. PCT/EP04/01243, filed on Feb. 11, 2004, which claims priority to German Patent Application No. 10305929.6, filed on Feb. 13, 2003.

TECHNICAL AREA

The invention concerns a process for igniting a gas stream and an arrangement for carrying out this process as can be used for a gas heating stove with gas regulator fittings.

PRIOR ART

Gas regulatory fittings for a gas heating stove or the like are available in a large number of designs. They serve to ignite and regulate a stream of gas flowing into a burner.

A valve device for controlling the ignition of a gas burner is familiar from the GB 2 351 341 A. An operating spindle is moved by hand into the ignition position, which opens the ignition locking valve. The operating spindle needs only be held a short time in this position as a microswitch is engaged when the operating spindle is moved. This causes a voltage to be made available from a power supply to engage the magnet. Ignition takes place by piezoelectric spark ignition. The power supply is switched off when the thermoelectric current provided by a thermocouple is sufficient to keep the ignition locking valve in its open position.

With this solution, having to operate the valve device manually is a disadvantage, which is unsatisfactory with inconveniently positioned installations or if it must be operated frequently. Additional effort is also needed to carry out the piezoelectric spark ignition. There is a further problem insofar as especially where there is a fairly large conduction gap between the ignition locking valve and the burner aperture there cannot yet be any ignitable gas mixture at the burner aperture, as the time between the ignition locking valve opening and ignition is relatively short.

Further to this DE 93 07 895 U describes a multi-function valve with thermoelectric locking for gas burners on heating devices. This multifunction valve uses a room's existing power supply to operate it. To ignite the gas stream a magnetic valve is energised via a pushbutton, opening the ignition locking valve. The gas stream is ignited at the same time. A thermocouple in the area of the ignited gas flame is heated and puts a magnetic insert into an energised condition via the resultant thermoelectric current. The magnet holds an anchor firm and so keeps the ignition locking valve linked to the anchor in the open position. Now the pushbutton can be released and the magnetic valve be de-energised.

Here it is a disadvantage that the pressure valve must be held long enough until the thermoelectric current holds the ignition locking valve in the open position. It is also a disadvantage that the power consumption is relatively high in view of the fact that the magnetic valve must remain energised for this time via the power supply.

PRESENTING THE INVENTION

The invention is based on the problem of developing a process to ignite a gas stream and an arrangement for carrying out this process to facilitate ignition by remote control. Furthermore the necessary power consumption must be kept sufficiently low to permit an integrable electricity source to be used. The structure should also be kept a simple as possible.

According to the invention the problem is solved as follows, that to ignite a gas stream by operating an electronic control unit stored by an electricity source an ignition locking magnet is controlled by generating a holding current to keep open a thermoelectric ignition locking valve blocking off the gas stream. As soon as the ignition locking magnet is energised an electromagnet is energised briefly by a voltage pulse, which causes an actuating strut to open the ignition locking valve and positions the anchor of the ignition locking magnet. The anchor is restrained by a holding current coming from the electricity source until the gas stream is ignited and a thermocouple provides the necessary holding current or a specified holding period has been exceeded.

For this the arrangement for igniting a gas stream consists of an electronic control unit fed from an electricity source, a thermoelectric ignition locking valve blocking off the gas stream, an ignition locking magnet and an actuating strut aligned with the ignition locking valve. The valve disc of the ignition locking valve is supported on a valve rod and loaded in the direction of closure by a restoring spring. The anchor of the ignition locking magnet is firmly fixed with the valve rod. On the one hand the winding of the ignition locking magnet lies within the circuit of a thermocouple heated by the gas flame and on the other it can be controlled by the electronic control unit.

The actuating strut aligned with the ignition locking valve is movable so far by an electromagnet in a longitudinal direction against the force of a restoring spring that the anchor of the ignition locking magnet bears against it and the valve disc is in the open position. The electromagnet is linked to the electronic control unit and can be energised for the duration of the impulse by an electric pulse.

There is also a drive unit controlling the gas flow to a main burner by means of a switch.

This has found a solution, which remedies the aforementioned disadvantages of prior art. A brief operation of the electronic control unit facilitates ignition of the gas stream. In view of the only pulsed operation of the electromagnet, which is independent of how long the control unit is operated, there is a very low power requirement. It also possible to access the electricity source to generate the pilot light, so that there is no need for the additional cost of a piezoelectric ignition device.

Other advantageous embodiments of the invention are derived from the other patent claims.

One advantageous embodiment of the process arises if, when the ignition flame is already alight, the stages referred to are skipped and the electronic control unit triggers a drive unit in such a way that the volume of gas flowing to the main burner is increased. The fact that there is automatically an increase in the volume of gas flowing to the main burner when the ignition flame is alight makes it possible to simplify design and operation.

In view of the low power requirement it also proves to be a particular advantage, if even while ensuring an adequate life the electricity source is from a battery the dimensions of which can be designed so small that it can be placed in a remote control together with the electronic control unit.

EMBODIMENT

Figure 2:
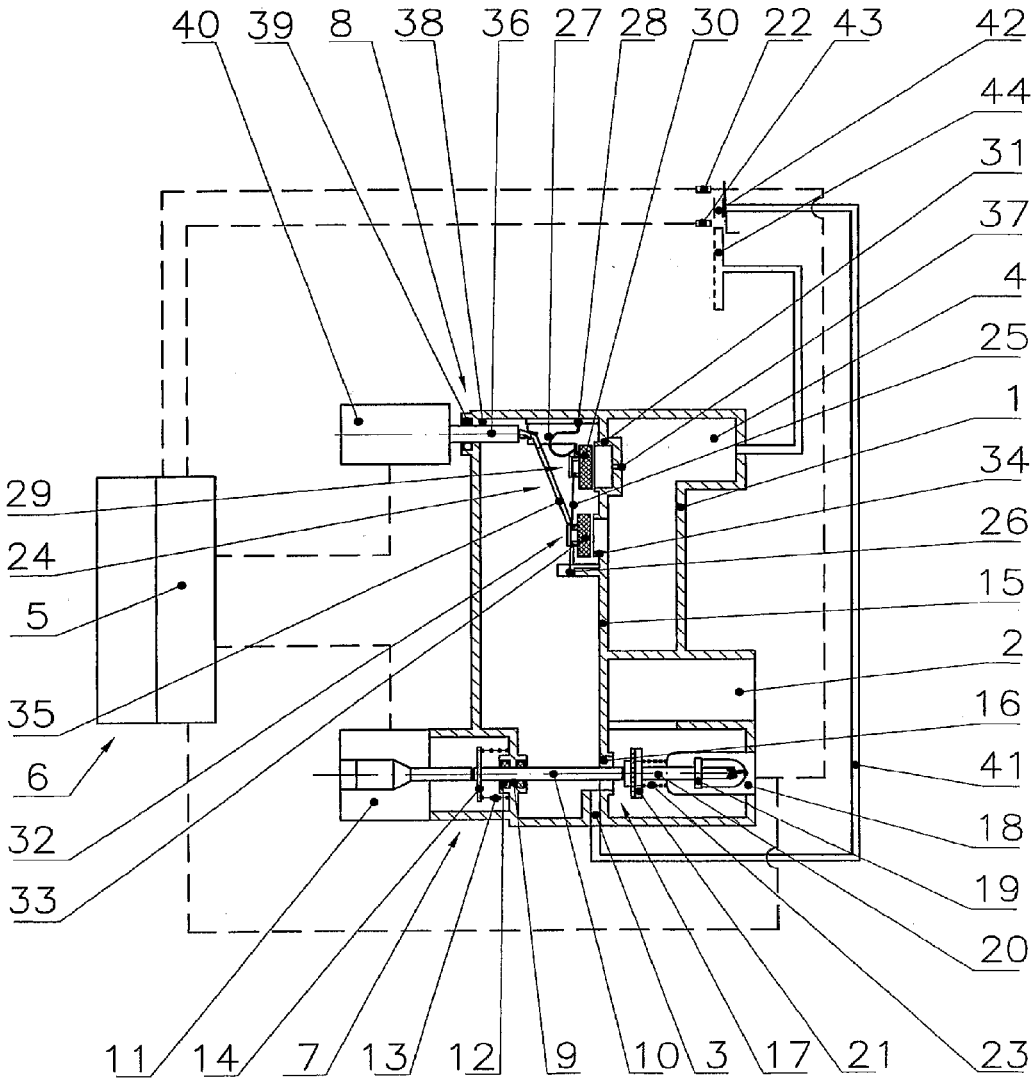

The procedure that is the subject of the invention to ignite a gas stream and the arrangement for carrying out this procedure is explained in further detail in an embodiment below. The embodiment shows a schematic representation of a gas regulating valve for a gas heating stove with an arrangement in accordance with the invention for igniting a gas stream. The individual representations show:

FIG. 1 a construction of a gas regulating valve in cross-section in the closed position, FIG. 2 a construction of a gas regulating valve in cross-section with activated startup.

Figure 3:
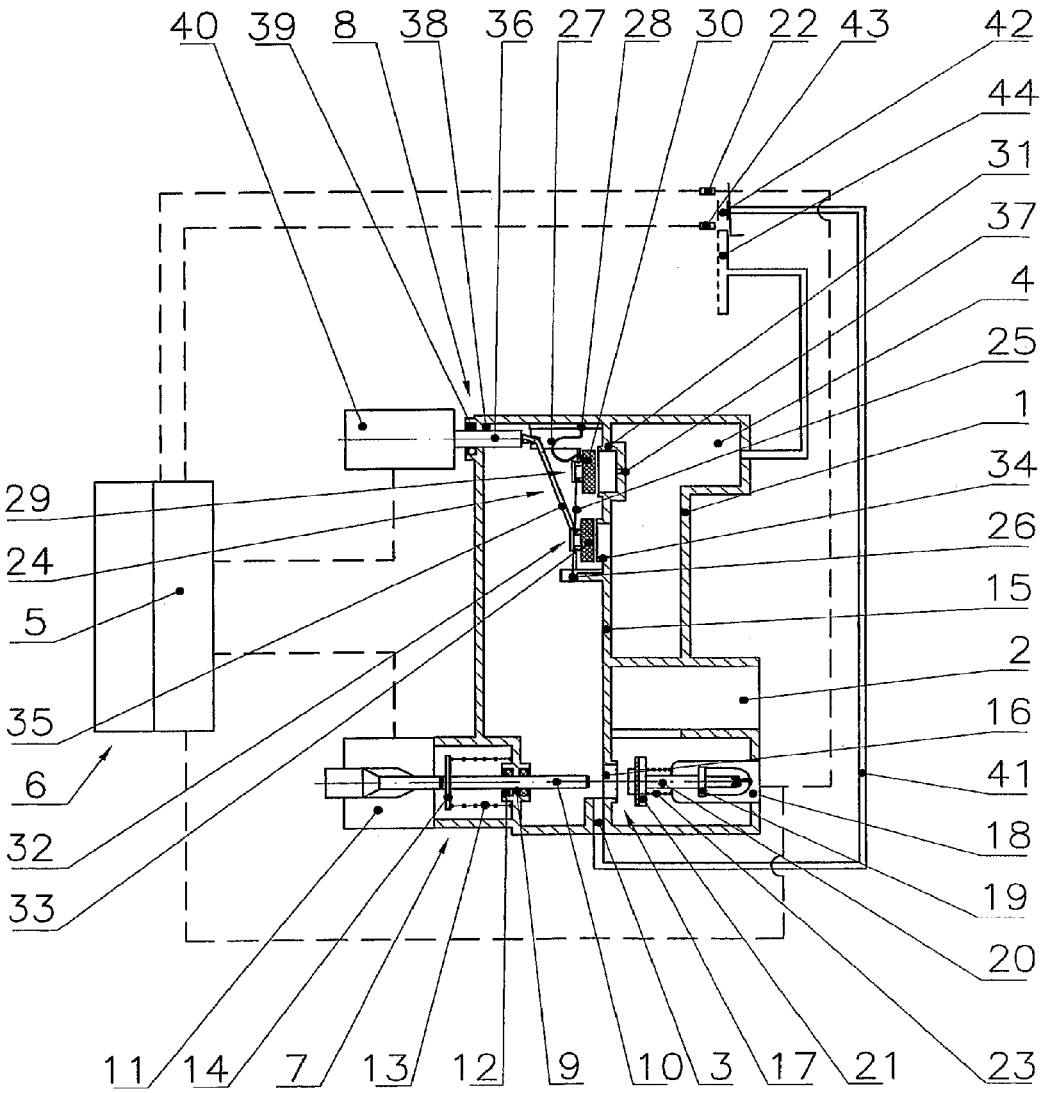
Figure 4:
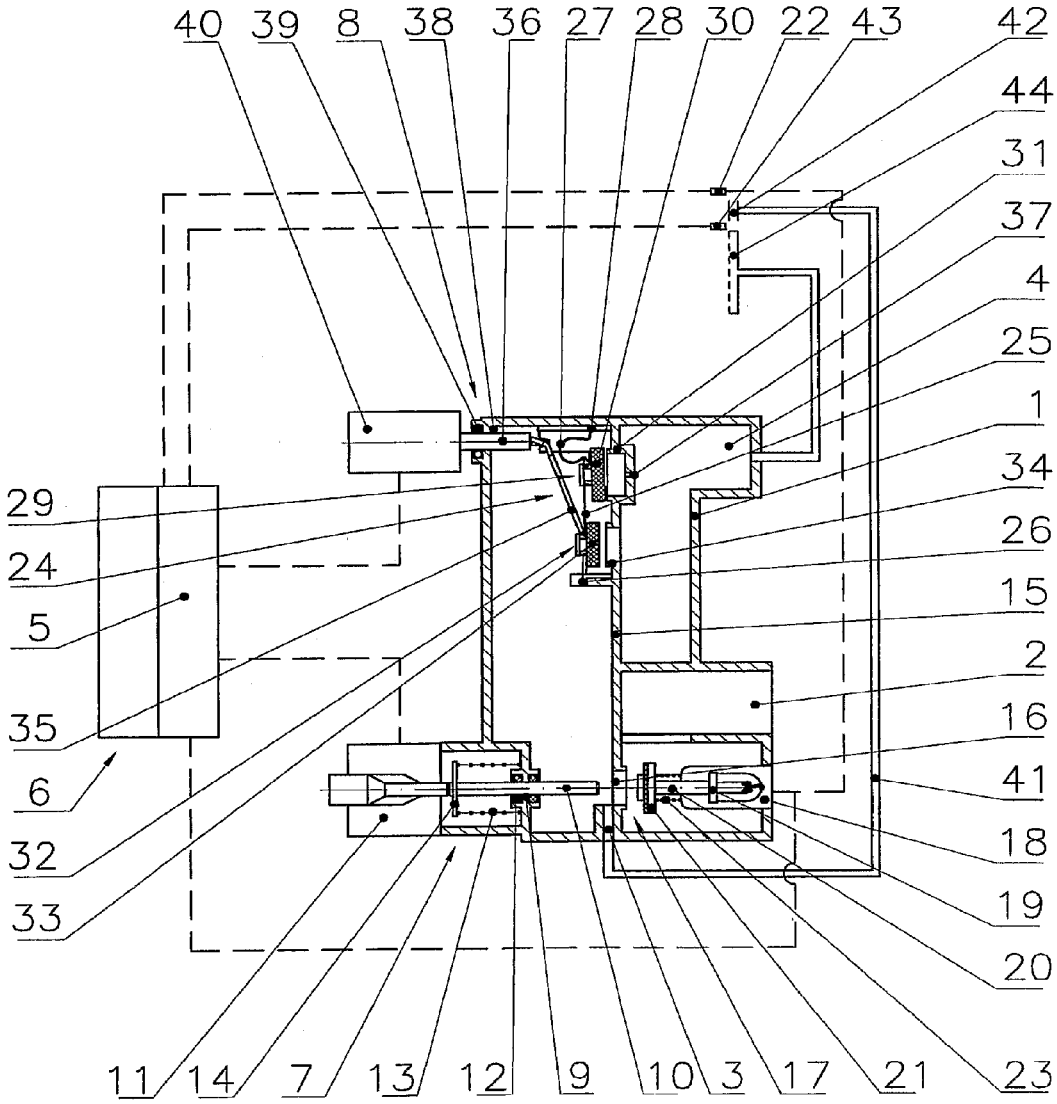

FIG. 3 a construction of a gas regulating valve in cross-section in ignition position, FIG. 4 a construction of a gas regulating valve in cross-section in the open position, The gas regulating valve in accordance with the invention exemplified in FIG. 1 is a switching and regulatory device that preferably intended for installation in a gas-heated chimney stove or similar. It facilitates the operation and monitoring of a burner where the gas volume flowing to the burner is controlled. The burner consists in this embodiment of an ignition burner 42 and a main burner 44.

This gas regulating valve consists of a housing 1, which has a gas input 2, an ignition gas output 3 and a main gas output 4. The individual functional units are in the housing 1.

It is triggered by an electronic control unit 5, which in this embodiment is in a separately located housing of a remote control 6 together with an electricity source.

The following functional units are accommodated in the gas regulating valve shown.

start-up 7 with safety pilot control unit 8 for the gas volume flowing to main burner 44

For start-up 7 an actuating strut 10, which can be operated by remote control 6 via an electromagnet 11 placed on housing 1, is fed so as to be movable lengthwise in a bearing 9 of housing 1, with the necessary gastightness being provided by Orings 12 for example.

Movement in a longitudinal direction is only possible against the force of a restoring spring 13 supported in housing 1. The starting position to be adopted under the force of restoring spring 13 is reached via a thrust bearing 14, that bears against a limit stop—not shown—in starting position on actuating strut 10. The end of actuating strut 10 extends into the interior of the housing.

The interior of housing 1 is subdivided into various compartments by a partition 15. Aligned with and as an extension to actuating strut 10 the partitition 15 has an initial opening 16, which belongs to an ignition locking valve 17. The ignition locking valve 17 is influenced by a thermoelectric ignition locking magnet 18 downstream from gas input 2 placed gas-tight in a bearing of housing 1. The thermoelectric ignition locking magnet 18 acts on an anchor 19, which is rigidly linked to a valve stem 20, on which the valve disc 21 of ignition locking valve 17 is fastened. The thermoelectric ignition locking magnet 18 can be energised via the electronic control unit 5 and a thermocouple 22 exposed to the pilot light.

The design and operation of ignition locking magnet 18 are otherwise familiar to specialists so that it is unnecessary to describe further details. It only needs to be emphasised that a restoring spring 23 endeavours to withdraw the anchor 19 from the ignition locking magnet 18 via the valve disc 21 serving as a spring hanger.

In the direction of flow behind start-up 7 there is a switch 24 inside the housing 1. The switch 24 has a unilaterally double-slit elastic spring 25, which on the one hand is supported at its two outer ends on the slit side in one bearing 26 in housing 1, while on the other hand its unslit side is connected by a lyre spring 27, which is supported in a second bearing 28 in housing 1. On the side turned toward the lyre spring 27 a first valve seating body 30 assigned to a first valve 29 is seated in a first pilot hole, to which a first valve seat 31 in partition 15 is assigned. In addition to this on the springy tongue of elastic spring 25 between the two outer ends a second valve seating body 33, assigned to a second valve 32, and to which a second valve seat 34 in the partition 15 is assigned, is seated in a second pilot hole. A lever 35 that is impinged on by a tappet 36 in housing 1, acts with its other end on the tongue of elastic spring 25. The travel of the switch is determined by the stops limiting the movement of elastic spring 25.

Switch 24 is designed so that a modulating control of valve 32 with a stepwise on and off switch in the part-load area is effected via valve 29. The part-load throughput is limited by the cross-section of aperture 37 in the partition.

The tappet 36 lengthwise movable and frictionally connected with switch 24 projects from the housing 1, which at the same time forms a bearing 38 for it. The necessary external gastightness is ensured by an O-ring 39 for example. With its end turned away from switch 24 the tappet 36 is connected to a drive unit 40, not explained in any further detail, as familiar to a specialist. The drive unit 40 is triggered by remote control 6 via the electronic control unit 5.

To carry out the procedure the electronic control unit 5 is operated via remote control 6. With the pilot already alight the drive unit 40 is immediately triggered by the electronic ignition unit 5. The volume of gas flowing to the main burner 44 is thereby increased in a manner to be subsequently explained.

If the pilot is not alight the drive unit 40 is also checked by the electronic control unit 5 before ignition for safety reasons to establish whether the two valves 29/32 are closed or are controlled to ensure that both valves 29/32 are closed. This operates the electromagnet 11 by an electric pulse so that the actuating strut 10 is moved in the direction of the ignition locking valve 17 and opens this sufficiently wide for the anchor 19 to bear against the ignition locking magnet 18 (FIG. 2). Apart from this the ignition locking magnet 18 is energised via the electronic control unit 5, so that from the time the anchor 19 strikes the ignition locking magnet 18, the anchor 19 is held in this position by the flow of holding current, i.e. in the open position of ignition locking valve 17, while the actuating strut 10 readopts its starting position because electromagnet 11 is de-energised after the pulse comes to an end and is subject to the effect of the restoring spring 13. The ignition gas can now flow via the ignition gas feed 41 to ignition burner 42, where it is ignited by ignition electrode 43. (FIG. 3).

The thermocouple 22 is heated by the burning pilot light. The resultant level of thermoelectric current is monitored by the electronic control unit 5. As soon as the thermoelectric current is sufficient it is switched off by the holding current from the electricity source.

Should no ignition of the ignition gas occur within a prescribed period of time, the electronic control unit 5 is switched off by the holding current from the electricity source, which de-energises the ignition locking magnet 18 and closes ignition locking valve 17.

Since the pilot light is alight the drive unit 40 can be manipulated via the remote control 6 and the electronic control unit 5. This opens switch 24 in a familiar manner, resulting in an abrupt detachment of valve seating body 30 from valve seat 31. The constant volume of gas limited by aperture 37 flows over the main gas output 4 to the main burner 44 and is ignited by the pilot light. The flames burn at a minimal level. Further operation of drive unit 40 results in the volume of gas flowing to the main gas burner 44 being uniformly increased as the valve seating body 33 is now detached from valve seat 34, achieving a uniform increase in the volume of gas flowing through valve 32. Switch 24 is now in the modulating range and valve 32 is opened uniformly until the maximum volume of gas is reached (FIG. 4).

The process that is the subject of the invention and the arrangement for carrying out the process are not of course limited to the embodiment described. Alterations, adaptations and combinations are possible without departing from the scope of the invention.

It is evident that the gas regulating valve for example can have further function units such as a pressure controller etc., apart from those mentioned. The transmission of control signals can, as is generally known, be made by infra-red, ultrasound radio waves etc.

It is also possible not to use a remote control 6, but for the electronic control unit 5 to be on or in housing 1.

LIST OF REFERENCE MARKS

1 housing 23 restoring spring
2 gas input 24 switch
3 ignition gas output 25 elastic spring
4 main gas output 26 bearing
5 control unit 27 lyre spring
6 remote control 28 bearing
7 start-up 29 valve
8 control unit 30 valve seating body
9 bearing 31 valve seat
10 actuating strut 32 valve
11 electromagnet 33 valve seating body
12 O-ring 34 valve seat
13 restoring spring 35 lever
14 thrust bearing 36 tappet
15 partition 37 aperture
16 aperture 38 bearing
17 ignition locking valve 39 O-ring
18 ignition locking magnet 40 drive unit
19 anchor 41 ignition gas feed
20 valve rod 42 ignition burner
21 valve disc 43 ignition electrode
22 thermocouple 44 main burner

The invention claimed is:

1. A method for igniting a stream of gas with a system including an electronic control unit (5) and an ignition locking valve (17) having a valve disc (21) and an anchor (19) operatively connected to the valve disc (21), the method comprising the steps of: briefly energizing an electromagnet (11) by an electric pulse so that an actuating strut (10) engages the valve disc (21) to open the ignition locking valve (17) and position the anchor (19) adjacent an ignition locking magnet (18) connected to the electronic control unit, generating a holding current from an electricity source connected to the electronic control unit, and energizing the ignition locking magnet (18) with the holding current via the electronic control unit (5) before the stream of gas is ignited to hold the ignition locking valve (17) open when the anchor (19) is positioned adjacent the ignition locking magnet (18) by the actuating strut (10), maintaining the energization of the ignition locking magnet (18) with the holding current via the electronic control unit (5) until the stream of gas has been ignited or a defined holding period has been exceeded.

2. A method in accordance with patent claim 1, further comprising the step of immediately triggering a drive unit (40) in response a pilot light being lit so that the gas volume flowing to a main burner (44) is increased.

3. A system for igniting a gas stream comprising:
a control unit (5) fed from an electricity source,
an ignition locking valve (17) for blocking off the gas flow to an ignition burner (42), the ignition locking valve (17) including:
a valve disc (21) seated on a valve rod (20) and loaded by a valve spring (23) in the direction of closure,
an ignition locking magnet (18) having a winding electrically connected to a thermocouple (22) heated by the gas flame and the control unit (5), and
an anchor (19) firmly connected to the valve rod (20),
an actuating strut (10) disposed in alignment with the ignition locking valve (17) and loaded by a strut spring (13),
an electromagnet (11) operable to briefly actuate the actuating strut (10) via an electric pulse provided by the electronic control unit (5) against the force of the strut spring (13) and movable in a longitudinal direction to engage the ignition locking valve (17) so that the anchor (19) bears against the ignition locking magnet (18) and the valve disc (21) is in the open position,
the control unit (5) configured to energize the ignition locking magnet (18) with the holding current before the stream of gas is ignited, and
a drive unit (40), which controls the volume of gas flowing to a main burner (44) via a switch (24).

4. A system in accordance with patent claim 3, wherein the electricity source comprises a battery.

5. A method in accordance with patent claim 1, further comprising the step of supplying thermoelectric current from a thermocouple to the ignition locking magnet (18) to energize the ignition locking magnet (18) if the stream of gas is ignited.

6. A method in accordance with patent claim 5, further comprising the step of switching off the electronic control unit (5) when the thermoelectric current reaches a sufficient magnitude.

* * * * *

UNITED STATES PATENT AND TRADEMARK OFFICE

CERTIFICATE OF CORRECTION

PATENT NO. : 8,668,490 B2
APPLICATION NO. : 10/545048
DATED : March 11, 2014
INVENTOR(S) : Barbara Happe and Jürgen Blank It is certified that error appears in the above-identified patent and that said Letters Patent is hereby corrected as shown below:

In the Claims

Column 6, Claim 2, line 12, “a” should read -- to a --.

Signed and Sealed this
Twenty-sixth Day of May, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,668,490 B2
APPLICATION NO. : 10/545048
DATED : March 11, 2014
INVENTOR(S) : Happe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1919 days.

Signed and Sealed this
Eleventh Day of August, 2015

Michelle K. Lee

Michelle K. Lee
*Director of the United States Patent and Trademark Office*